US008359804B2

(12) United States Patent
Wakefield

(10) Patent No.: US 8,359,804 B2
(45) Date of Patent: Jan. 29, 2013

(54) INTERLOCKABLE TILES

(75) Inventor: Trevor John Wakefield, Minsterley (GB)

(73) Assignee: Green IP Box Limited, Dublin (IE)

( * ) Notice: Subject to any disclaimer, the term of this patent is extended or adjusted under 35 U.S.C. 154(b) by 3 days.

(21) Appl. No.: 12/995,349

(22) PCT Filed: Jul. 29, 2009

(86) PCT No.: PCT/GB2009/050938

§ 371 (c)(1), (2), (4) Date: Nov. 30, 2010

(87) PCT Pub. No.: WO2010/013045

PCT Pub. Date: Feb. 4, 2010

(65) Prior Publication Data

US 2011/0072755 A1 Mar. 31, 2011

Related U.S. Application Data

(60) Provisional application No. 61/084,284, filed on Jul. 29, 2008.

(30) Foreign Application Priority Data

Jul. 29, 2008 (GB) ..... 0813800.0
Nov. 14, 2008 (GB) ..... 0820836.5

(51) Int. Cl.
*E04B 2/30* (2006.01)

(52) U.S. Cl. ..... 52/526; 52/483.1; 52/527

(58) Field of Classification Search ..... 52/518, 52/519, 523, 526, 533, 553, 748.1
See application file for complete search history.

(56) References Cited

U.S. PATENT DOCUMENTS

| | | | | |
|---|---|---|---|---|
| 465,364 | A * | 12/1891 | Donaldson | 52/533 |
| 4,731,969 | A * | 3/1988 | Baker et al. | 52/536 |
| 4,754,589 | A * | 7/1988 | Leth | 52/538 |
| 5,465,547 | A * | 11/1995 | Jakel | 52/518 |
| 6,336,303 | B1 * | 1/2002 | Vandeman et al. | 52/520 |
| 7,331,150 | B2 * | 2/2008 | Martinique | 52/520 |
| D643,548 | S * | 8/2011 | Wakefield | D25/140 |
| 2001/0022055 | A1 * | 9/2001 | Zhang | 52/309.1 |
| 2003/0061778 | A1 * | 4/2003 | Fifield et al. | 52/536 |
| 2006/0026908 | A1 * | 2/2006 | Gregori et al. | 52/105 |

FOREIGN PATENT DOCUMENTS

| | | | |
|---|---|---|---|
| CH | 291756 | | 7/1953 |
| DE | 3037853 | | 4/1981 |
| FR | 1097530 | | 7/1955 |
| FR | 1303992 | | 9/1962 |
| FR | 2567178 | * | 6/1984 |

(Continued)

*Primary Examiner* — Jeanette E Chapman
*Assistant Examiner* — Daniel Kenny
(74) *Attorney, Agent, or Firm* — King & Schickli, PLLC

(57) ABSTRACT

An interlockable tile (100) includes a plurality of sets of upper surface arrangements (110A-110C, 110A'-110C') and a corresponding plurality of sets of underside arrangements (109'). First sets of the upper surface arrangements (110A-110C) and the underside arrangements are located at or adjacent a first side edge (104C) of the tile (100). Second sets of the upper surface (110A-110C') and the underside arrangements are located at or adjacent an opposite side edge (104D) of the tile, in use, the upper surface arrangement of the tile interlocking with a corresponding underside arrangement on an overlapping tile. The tile also includes a first formation (114) at or adjacent one side edge (104C), and a second formation (112) at or adjacent an opposite side edge (104D) that, in use, interlocks with a corresponding said first formation of an adjacent roof tile.

26 Claims, 10 Drawing Sheets

FOREIGN PATENT DOCUMENTS

| | | |
|---|---|---|
| GB | 2335673 | 9/1999 |
| GB | 2382356 | 5/2003 |
| WO | 03106781 | 12/2003 |
| WO | 2006092267 | 9/2006 |

* cited by examiner

INTERLOCKABLE TILES

This application is the national stage of PCT/GB2009/050938, filed Jul. 29, 2009, which claims priority from British Patent Application Ser. Nos. 0813800.0, filed Jul. 29, 2008, 0820836.5, filed Nov. 14, 2008, and U.S. Provisional Patent Application Ser. No. 61/084,284, filed Jul. 29, 2008, the disclosures of which are incorporated herein by reference.

FIELD OF THE INVENTION

The present invention relates to interlockable tiles.

BACKGROUND OF THE INVENTION

There are many types of known tiles. Commonly, they are formed of slate, clay or concrete and are susceptible to breakage during transit and installation. Further, these types of materials mean that the tiles are relatively heavy. In the case of roof tiles, tiles are often carried by roofers on their shoulders, which restricts vision and hinders movement. This can result in accidents, such as if a roofer breaks a batten between rafters after positioning a hand/foot incorrectly due to restricted vision. Further, the cost of transporting such products is also high.

Although various types of interlocking roof tiles are available, no known product includes arrangements incorporated into its design that are intended to assist roofers with stretching methods in order to gain or lose width caused by roofs being out of square, whilst at the same time bonding straight or helping with adjustments to the gauge settings.

Embodiments of the present invention are intended to address at least some of the abovementioned problems.

SUMMARY OF THE INVENTION

According to a first aspect of the present invention there is provided an interlockable tile including:

an underside arrangement;

an upper surface arrangement, in use, the upper surface arrangement of the tile interlocking with a corresponding underside arrangement on an overlapping tile.

There may be a plurality of sets of upper surface arrangements and a corresponding plurality of sets of underside arrangements, with a first one of the sets of the upper surface arrangements and a first one of the sets of the underside arrangements being located at or adjacent a first side edge of the tile and a second one of the sets of the upper surface arrangements and a second one of the sets of the underside arrangements being located at or adjacent an opposite side edge of the tile, in use, the upper surface arrangement of the tile interlocking with a corresponding underside arrangement on an overlapping tile;

The underside arrangement and/or the upper arrangement of the tile can include a plurality of formations spaced from an upper or lower edge of the tile by different distances so that, in use, the plurality of formations provide a range of tiling gauges for the overlapping tiles.

The tile may further include:

a first formation at or adjacent one side edge, and a second formation at or adjacent an opposite side edge that, in use, interlocks with a corresponding said first formation of an adjacent tile, wherein the first formation includes a first preformed aperture for receiving, in use, a fixing device such as a nail, and the second formation includes a second preformed aperture for receiving, in use, the fixing device such that when, the first formation is interlocked with a said second formation of another tile, the first and second apertures are aligned to allow the fixing device to pass through the first and second apertures.

At least one of the first and second apertures may be elongate.

The tile may further include an underside arrangement and an arrangement on an upper surface of the tile that, in use, interlocks with a corresponding underside arrangement on an overlapping tile.

The first side edge formation may include an elongate protrusion and the second side edge formation may include a recess or slot in the opposite side edge. Engagement of the first and second side edge formations, in use, when the tile is interlocked with an adjacent tile, allows an upper surface of the tile to lie flush with an upper surface of the interlocked tile. At least a portion of the elongate protrusion may be angled to form a water run located, in use, beneath a join between side edges of adjacent tiles.

The upper surface (or underside) arrangement may include a set of apertures arranged in a line at or near an upper edge portion of the tile. All or some of the plurality of formations may have an associated an elongate slot that extends sideways across the tile, thereby, in use, allowing for sideways movement of another tile that is interlocked with the tile. The underside (or upper surface) arrangement may be arranged at or near a lower edge portion of the tile and may include a projection dimensioned to fit in one of the set of apertures of another said tile. A plurality of sets of the upper surface (or underside) arrangements may be provided. For example, a first one of the sets may be located at or adjacent a first side edge of the tile and a second one of the sets may be located at or adjacent an opposite side edge of the tile. At least one further said set may be located between the first and second set. A corresponding plurality of sets of the underside (or upper surface) arrangements may also be provided.

The tile may further comprise a nib that, in use, hooks over a roofing batten. A portion of the nib may be formed on the first side edge formation. The underside of the tile may further include a reinforcing rib. The reinforcing rib may comprise an elongate member, e.g. one having a V-shaped cross-section, that extends between the first side edge and the opposite side edge of the tile. The tile may include a profiled section/foot at its lower edge, in use, the profiled section overlapping an upper portion of an overlapping tile.

The tile may be generally square or rectangular in plan view. The tile may have a length of 375 mm and a width of 300 mm. Alternatively, the tile can have dimensions of 600 mm×300 mm, or 900 mm×300 mm. A side edge portion of the tile can include an arrangement for receiving/connecting to a verge attachment. In a set of tiles, at least one of the tiles can be around 50% wider than other tiles in the set.

The tile may be formed of a rigid plastic material, which may include recycled plastic. In some embodiments, the tile may be formed of a mixture of pulverised fuel ash (PFA) and plastic, such as polyethylene, e.g. around 70% PFA and around 30% high density polyethylene.

The underside arrangement (or another portion/component of the tile) may fit into a clipping device, which may be fitted at a fascia of a building structure. The clipping device may include a pivotable member including an arrangement for receiving the tile underside arrangement (or other portion/component), the member being pivotable so as to allow the tile to be fitted at an angle corresponding to a pitch of a roof.

According to another aspect of the invention there is provided a set of tiles substantially as described herein. According to another aspect there is provided a kit including a set of said tiles and a set of strips of material adapted to fix the tiles to a fascia board.

According to another aspect of the invention there is provided a roof (or a building structure) laid with a set of tiles substantially as described herein.

According to another aspect of the invention there is provided a method of laying a set of tiles substantially as described herein, the method comprising laying a first said tile in the set on a roof batten and laying a next tile in the set such that the formations/arrangements on the tiles interlock.

According to another aspect of the present invention there is provided an interlockable tile comprising:

a first formation at or adjacent one side edge, and a second formation at or adjacent an opposite side edge that, in use, interlocks with a corresponding said first formation of an adjacent tile, wherein the first formation includes a first preformed aperture for receiving, in use, a fixing device such as a nail, and the second formation includes a second preformed aperture for receiving, in use, the fixing device such that when, the first formation is interlocked with a said second formation of another tile, the first and second apertures are aligned to allow the fixing device to pass through the first and second apertures.

According to a general aspect of the present invention there is provided an interlockable tile comprising:

a first formation at one side edge and a second formation at an opposite side edge that, in use, interlocks with a corresponding said first formation on an adjacent tile, and/or an underside arrangement and an arrangement on an upper surface of the tile that, in use, interlocks with a corresponding underside formation on an overlapping tile.

According to yet another aspect of the present invention there is provided a tile including an underside arrangement and an arrangement on an upper surface of the tile that, in use, interlocks with a corresponding underside formation on an overlapping tile, wherein the upper surface arrangement includes a plurality of formations spaced from an upper edge of the tile by respective different distances.

According to another aspect of the present invention there is provided a tile formed of a mixture of pulverised fuel ash (PFA) and plastic. The tile may comprise around 70% PFA and around 30% high density polyethylene and in some cases additional materials may be used. There is also provided a method of forming a tile substantially as described herein.

According to yet another aspect of the present invention, there is provided a clipping device, which may be fitted at a fascia of a building structure, the clipping device including a pivotable member including an arrangement adapted to receive a portion/component of a (roof) tile, in use, the member being pivotable so as to allow the tile to be fitted at an angle corresponding to a pitch of a roof. The portion/component will typically be located on an underside of the tile.

Whilst the invention has been described above, it extends to any inventive combination of features set out above or in the following description. Although illustrative embodiments of the invention are described in detail herein with reference to the accompanying drawings, it is to be understood that the invention is not limited to these precise embodiments. As such, many modifications and variations will be apparent to practitioners skilled in the art. Furthermore, it is contemplated that a particular feature described either individually or as part of an embodiment can be combined with other individually described features, or parts of other embodiments, even if the other features and embodiments make no mention of the particular feature. Thus, the invention extends to such specific combinations not already described.

BRIEF DESCRIPTION OF THE DRAWING FIGURES

The invention may be performed in various ways, and, by way of example only, embodiments thereof will now be described, reference being made to the accompanying drawings in which.

Figure 3:
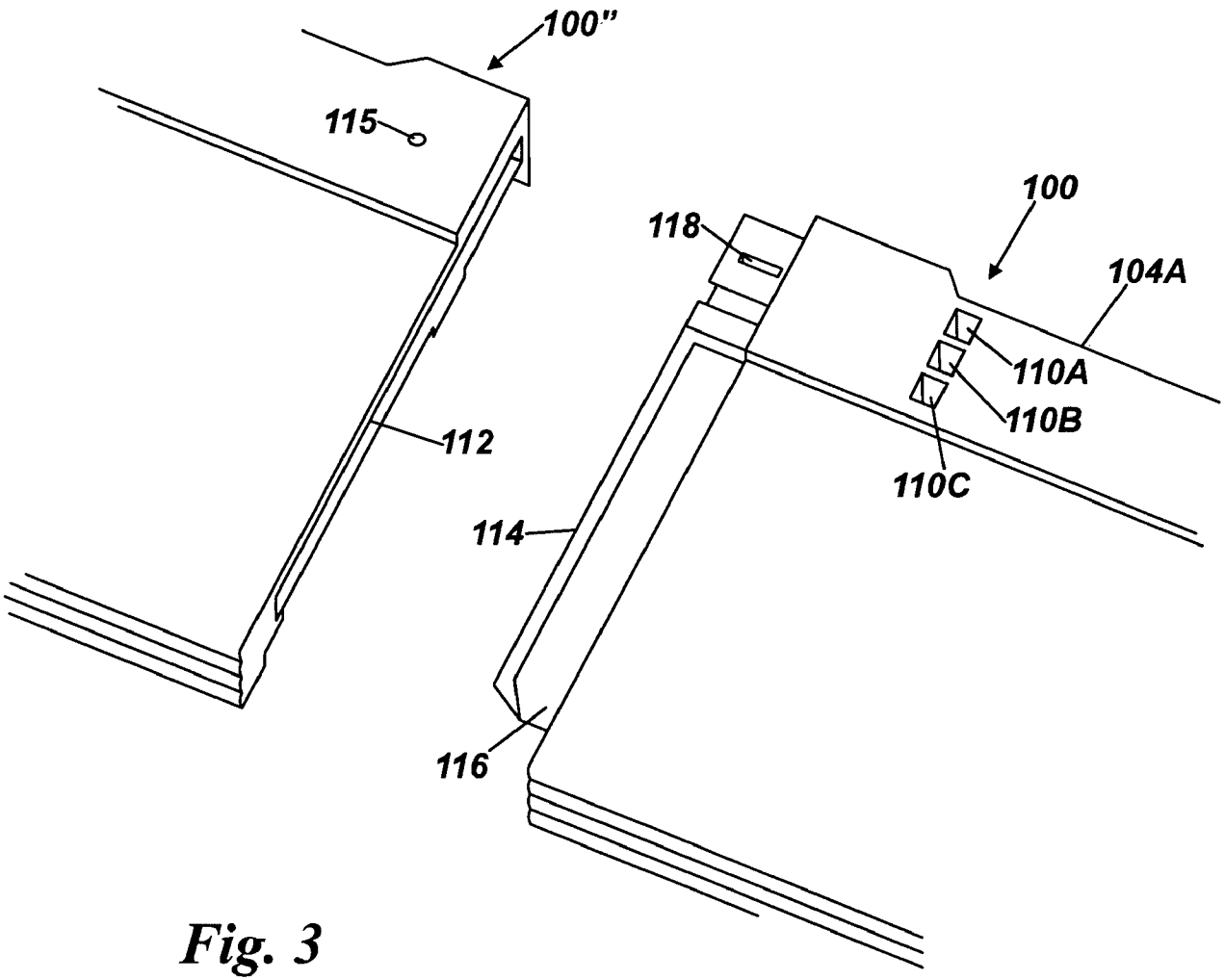
FIG. 3 illustrates a part of the tile next to another tile with which it is to be interlocked.
Figure 5:
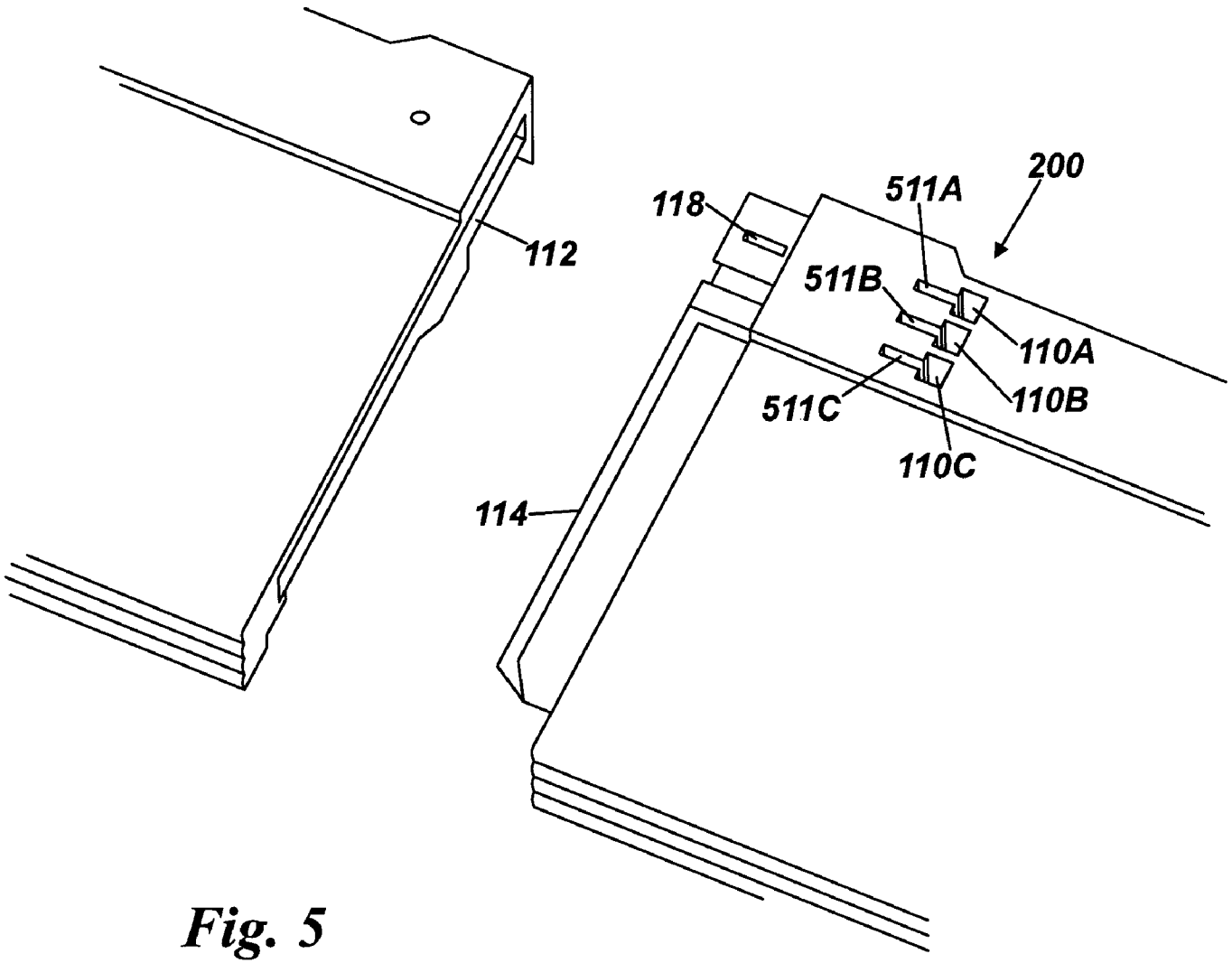
Figure 6A:
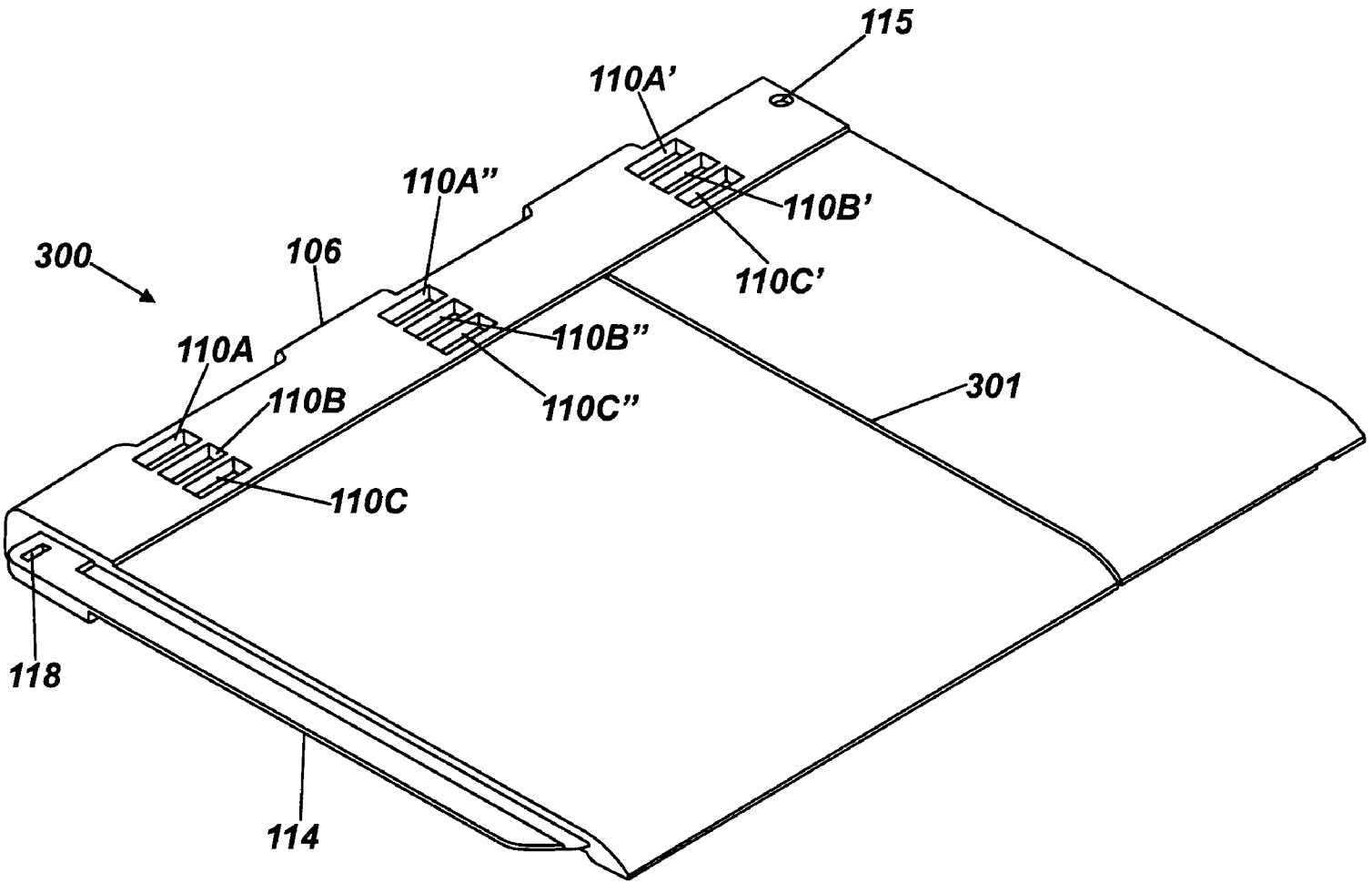
Figure 6B:
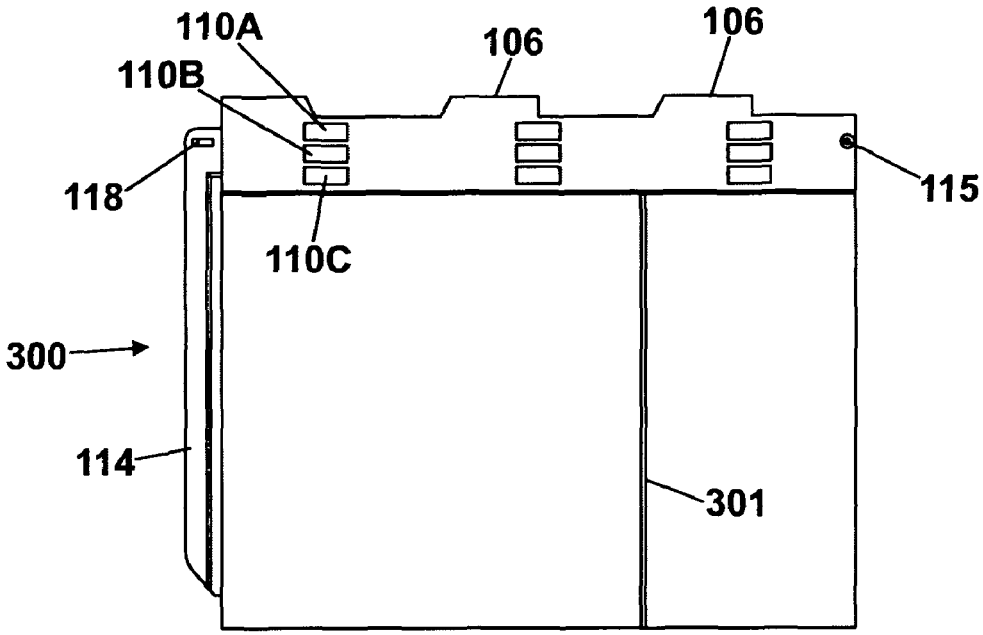
Figure 6C:
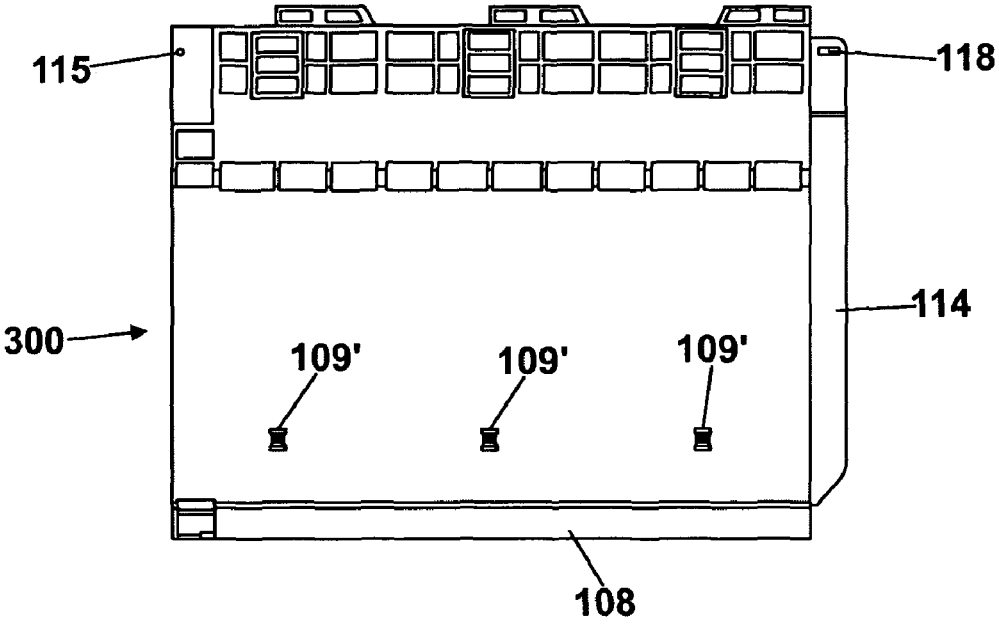
Figure 7A:
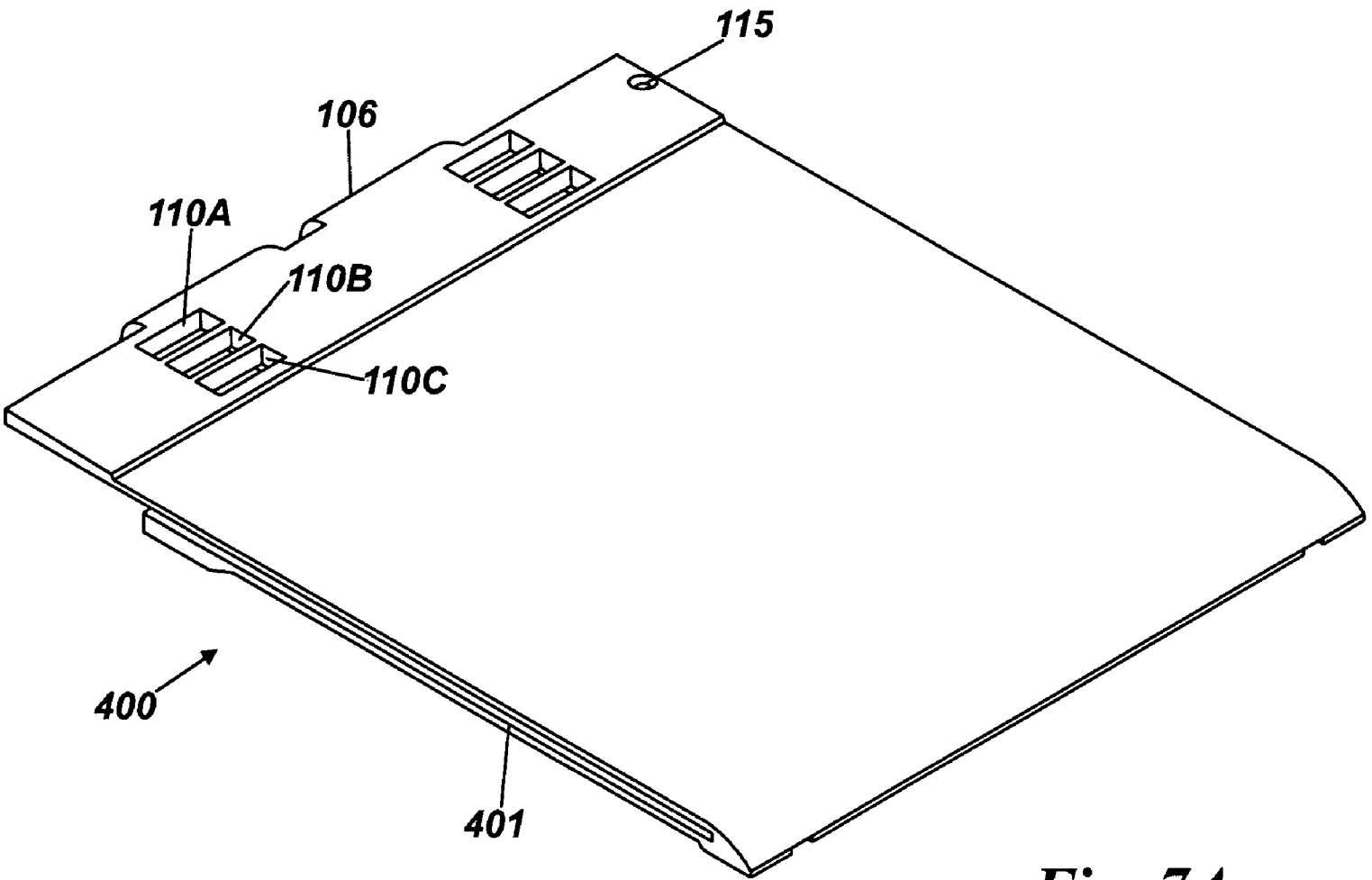
Figure 7B:
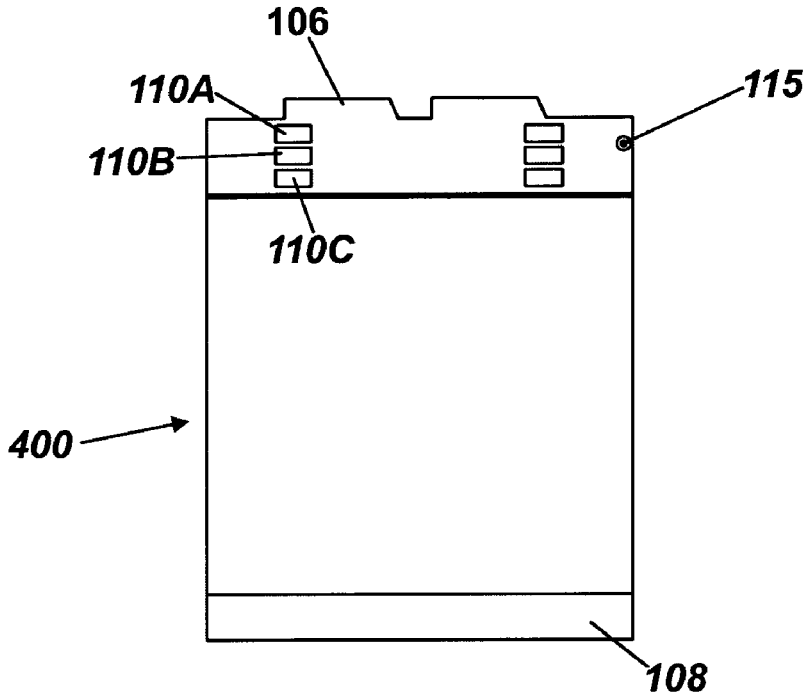
Figure 7C:
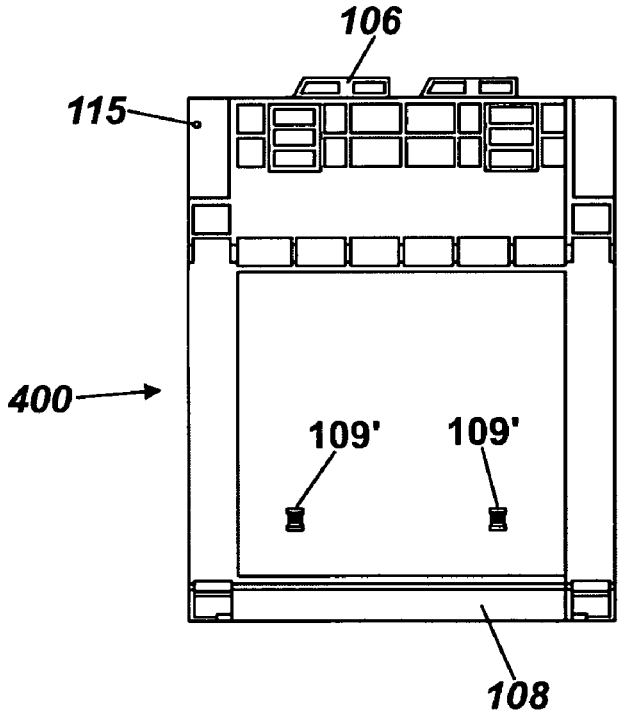
Figure 8A:
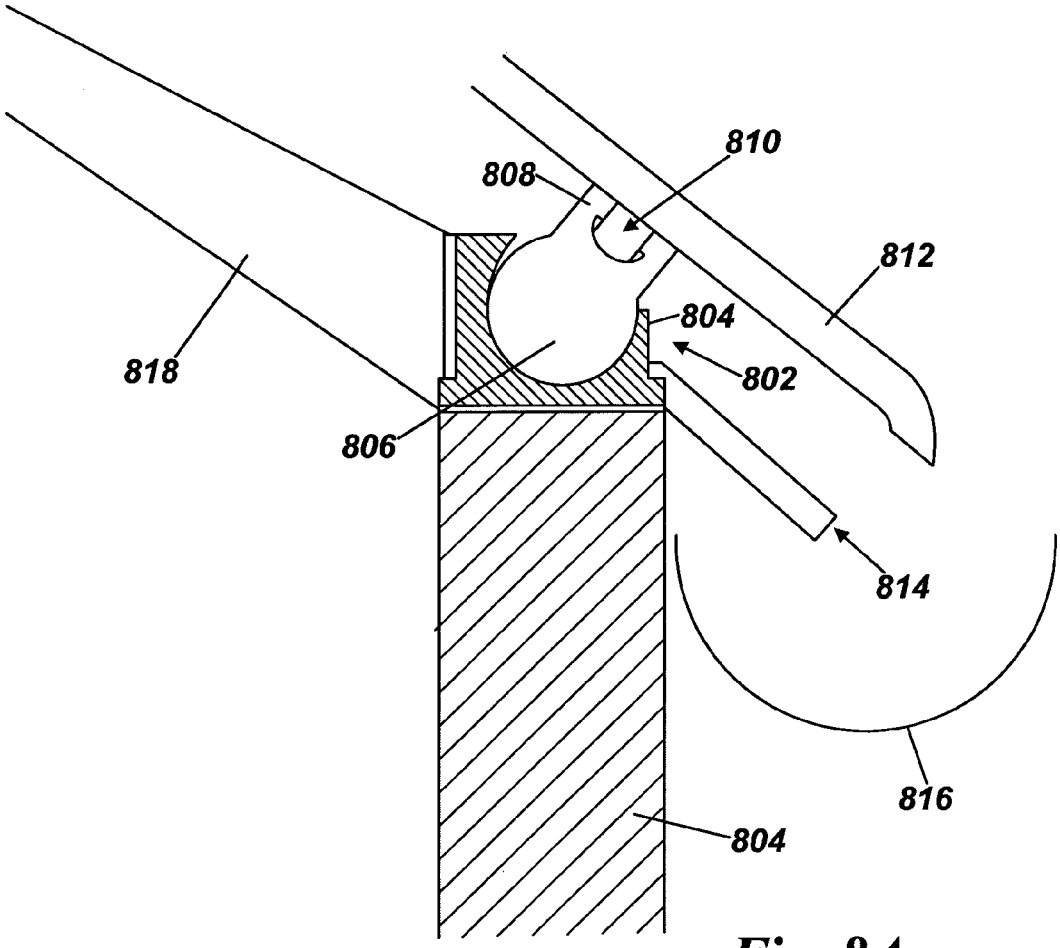
Figure 8B:
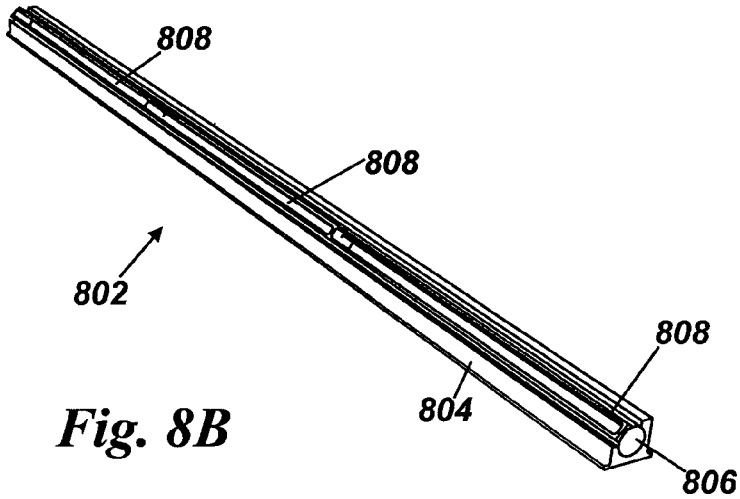

FIG. 5 corresponds to FIG. 3, but shows an alternative embodiment of the tile;

FIGS. 6A, 6B and 6C are perspective, plan and underside views, respectively, of yet another embodiment;

FIGS. 7A, 7B and 7C are perspective, plan and underside views, respectively, of a further embodiment;

FIG. 8A is a cross sectional view through a tile fitted on a clipping device, and FIG. 8B is a perspective view of the clipping device.

DETAILED DESCRIPTION OF THE INVENTION

Figure 1:
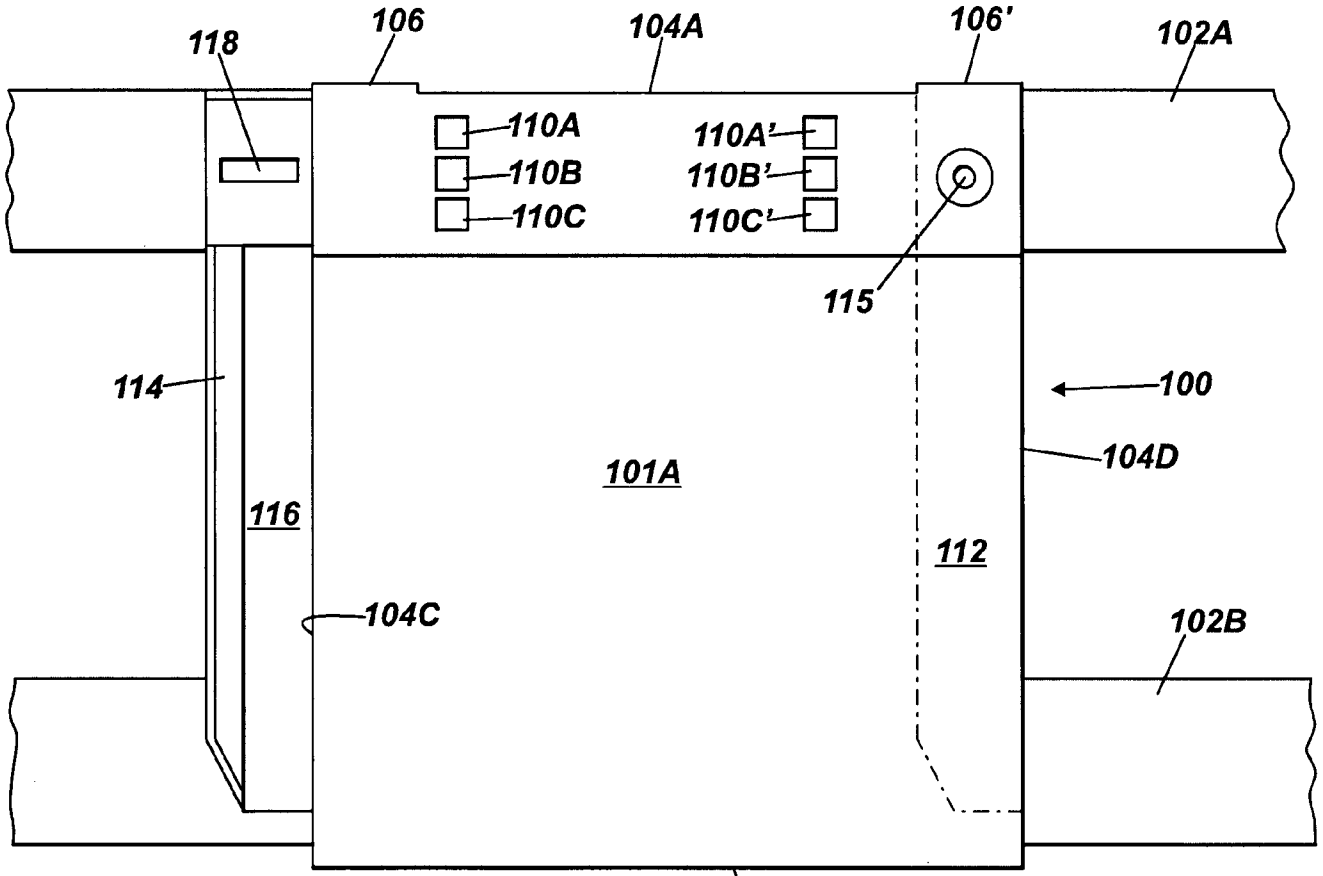
FIG. 1 is a schematic plan view of an example interlockable tile.
Figure 2:
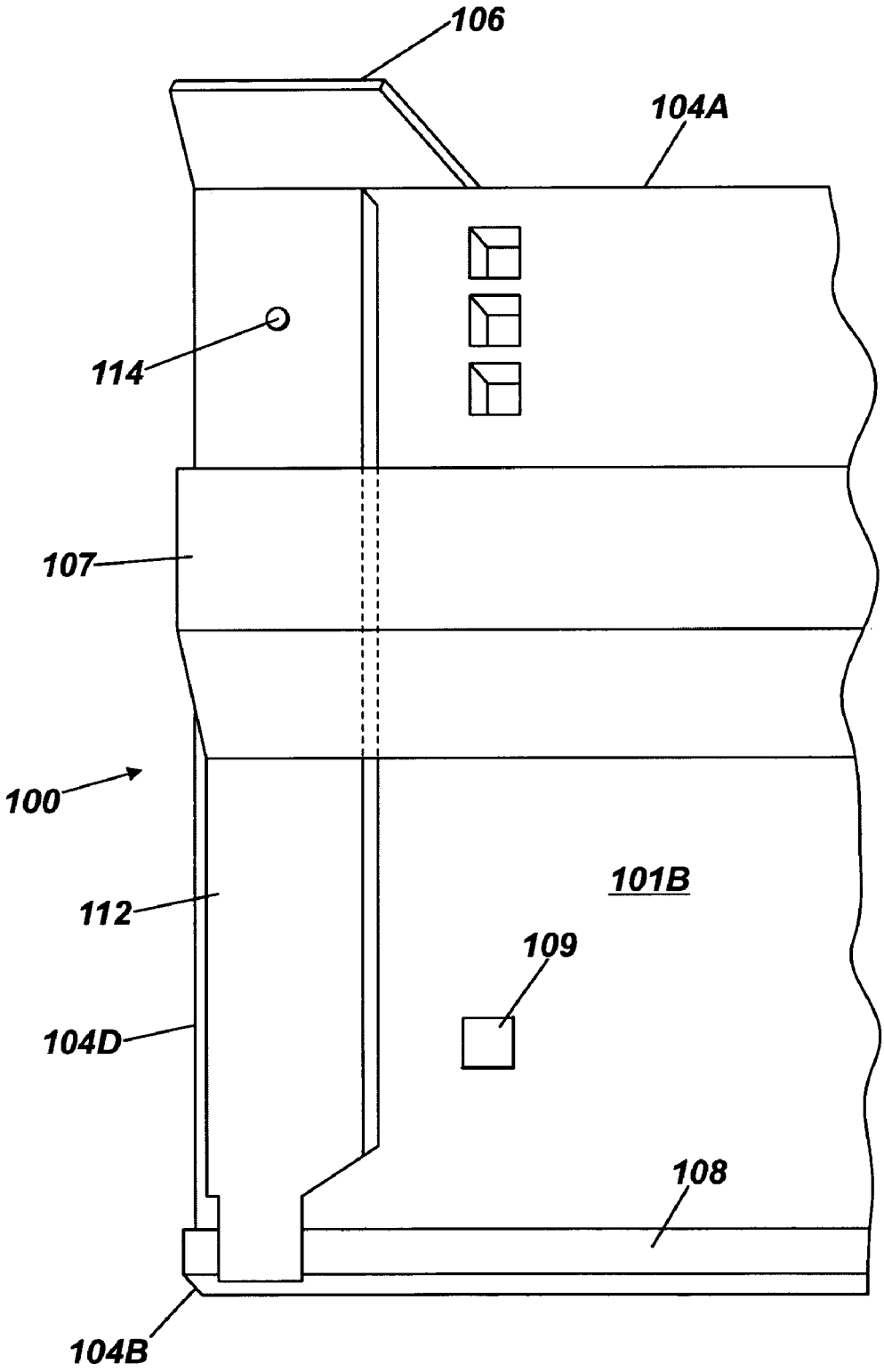
FIG. 2 is a schematic view of a portion of the underside of the tile.

Referring initially to FIGS. 1 and 2, an example tile 100 is shown. The tile can be formed of any suitable material, including conventional ones such as concrete, but it is particularly advantageous if the tile is formed of a lightweight material having a long life cycle, such as a rigid plastic. There can be environmental/economic advantages if the plastic material used is recycled. The texture and design of the tile can be such that it has a similar appearance to conventional, e.g. slate, tiles so that it can blend in with existing roofing if needed. Thus, the tile may be considered to comprise a man-made interlocking slate. The tiles can be used for roofing, but also for external (e.g. slate) vertical tiling and versions can be produced that are suitable for floor and wall tiling. It will be appreciated that the tile interlocking arrangements described herein can be modified so that tiles surrounding the tile have flush exposed surfaces.

The tile can be formed by any suitable manufacturing method, e.g. injection moulding when plastic is used. Alternatively, the tile may be formed of a mixture of pulverised fuel ash (PFA) and polyethylene, e.g. around 70% PFA and around 30% high density polyethylene. The PFA can be heated and compounded into granules and then injection-moulded to form the tiles. Additives such as flame-retardants can also be used in some embodiments. It will be appreciated that the dimensions and design of the tile can be varied. In one example, the overall length/width of the main area of the tile is 375 mm×300 mm, which is a size commonly used and preferred by tradesmen in the UK. However, it will be understood that tiles of virtually any reasonable dimensions (e.g. 600 mm×300 mm or 900 mm by 300 mm may be used for larger areas) can be formed.

The tile 100 is generally rectangular in shape and includes an upper surface 101A and an underside 101B. An upper edge of the tile is labelled 104A in FIG. 1, whilst its lower edge is labelled 104B. The left-hand side edge of the tile in FIG. 1 is labelled 104C and the straight, clean cut right-hand side edge is labelled 104D. At the upper edge 104A there is at least one depending nib 106. In the illustrated example, there are two nibs 106, 106', each nib being located at opposite side edges of the tile. As shown in FIG. 1, the nibs can be used to hook the tile over a roofing batten 102A. The nibs may include a preformed aperture/bore (not illustrated) for receiving a nail or the like to help fix the tile to the batten, in addition to any abutting tiles. This is especially useful if the tile is to be fitted in a substantially vertical orientation, e.g. the nib being set on an upper surface of the batter and the main surface of the tile being set on a side surface of the batten.

The underside of the tile also includes a strengthening rib 107, which, in example, takes the form of an elongate member having a V-shaped cross-section that extends all the way from the left-hand side edge to the right-hand side edge. However, it will be understood that variations are possible, e.g. the strengthening member can have a different profile and need not extend across the entire width of the tile, or extending in a different, e.g. diagonal, direction.

In use, the batten 102A will be located between the nib 106 and the strengthening rib 107, thereby helping secure the tile in place on the roof. The lower portion (adjacent edge 104D) of the tile can rest on another batten 102B. Along the lower edge 104B of the underside 101B of the tile at the there is a foot portion 108.

Towards the upper edge 104A of the tile there is at least one formation on the upper surface that is intended to assist the tile with interlocking with another tile that will partially lie on top of it in use. In the example the upper surface formations comprise a set of three apertures/bores 110A to 110C. The three bores are arranged in a straight line that extends from near the upper edge 104A down toward the lower edge. The centre of each of the bores 110A to 110C is therefore located a different distance away from the upper edge 104A.

As can be seen in FIG. 2, the underside of the tile includes a formation 109 towards the lower edge 104B of the tile. In the example, the underside formation 109 comprises a square-shaped protrusion that is designed to fit into one of the square-shaped bores 110A to 110C. It will be appreciated that variations to the illustrated upper surface and/or underside interlocking formations are possible, e.g. there may be more than one protrusion on the underside and the location, and/or the dimensions and shape of the formations can vary. In the example tile of FIG. 1 there are two sets (110A-110C and 110A'-110C) of three projections on the upper surface and a corresponding pair of projections (only one of which is visible in FIG. 2) on the underside but, again, it will be understood that variations are possible and there may be more or less than two sets of interengaging formations on the upper surface and/or the underside of the tile. For instance, the lower surface of the tile may include a set of spaced-apart arrangements (in addition to, or instead of, such a set on the upper surface) in order to provide different tile "gauges", as discussed below. The upper/underside arrangements could be located at/near the lower edge 104B of the tile instead of the top edge 104A.

As best seen in FIG. 2, the underside of the tile is formed with a receiving portion 112 at side edge 104D (this is also shown in phantom line in the plan view of FIG. 1). The receiving portion 112 includes a slot 116 that is open at the side edge 104D of the tile. The shape of the receiving portion is formed to correspond with a protrusion on the opposite side edge of the tile, which will be described below. A part of the receiving portion 112 near the lower edge 104B of the tile is angled downwards from the upper surface 101A of the tile to the underside 101B so as to form a water run.

Located at the upper right-hand corner of the tile is a preformed aperture 115 that passes through the upper surface of the tile, its underside and out through the lower surface of the receiving portion. The hole 115 is dimensioned so as to allow a nail (e.g. 0.5 mm), screw or the like to pass through it and a depressed area may be formed on the upper surface of the tile around the aperture to accommodate the head of a nail/screw during use.

At the left-hand side edge 104C there is a protruding arrangement 114. In use, the protruding arrangement 114 is slide-fitted into a receiving portion of another tile that fitted is onto the side edge 104D of tile 100. The protrusion 114 has a width of around 30 mm and extends from near the upper edge 104 of the tile to near the lower edge 104B. The protrusion is generally rectangular, but includes a cut-away portion at the lower left-hand corner (in FIG. 1) and is designed to fit into the receiving portion 112. It will be understood that the design of the protrusion (and corresponding receiving portion) can vary, e.g. a set of spaced-apart protrusions/pegs may be provided. A portion 116 of the protrusion adjacent the left side edge 104C of the tile slopes down from the upper surface 101A of the tile so as to form a valley that can act as a water run in use. Advantageously, this valley is located beneath the join between two interlocked adjacent tiles.

The protrusion 114 further includes a preformed elongate slot 118 near the upper edge 104A of the tile. In use, when the protrusion 114 is fitted into the receiving portion 112 of an adjacent tile, the slot 118 will be aligned with the hole 115 of the adjacent tile, allowing a nail to pass through both tiles, thereby securing them to the underlying batten. In the example, the slot 118 is elongated so as to allow for some sideways relative movement of the tiles, but it will be understood that the apertures can take other forms.

Figure 4:
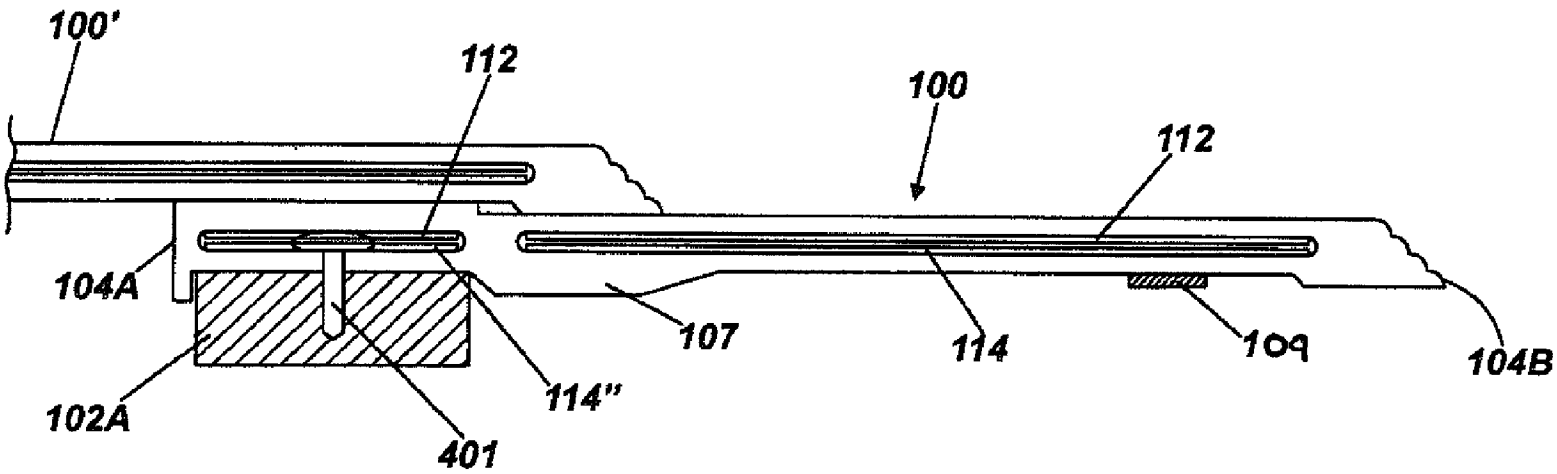
FIG. 4 is a schematic semi-transparent view of the tile being partially overlapped by another tile.

In use, the tile 100 is hooked over a batten in the desired location on the roof as outlined above. The next tile to be fitted is then placed on the batten (conventionally to the left of the previous tile) and moved sideways, as shown by the arrow in FIG. 3, so that the protruding arrangement 112 of the right-hand tile enters the receiving portion 112 of the left-hand tile. (It will be understood that side edge locations of the protrusions/receiving portions could be swapped if desired, but roof tiles are conventionally laid in a right to left direction). The left-hand tile is then pushed close to the other tile, and their side edges may contact each other, so that the hole 115 and slot 118 on each of the tiles are aligned. Engagement of the protrusion and receiving portion in the example allows the upper surface of the tile 100 to be flush with the upper surface of the adjacent interlocked roof tile, although it will be understood that the design can vary so that this is not the case. A nail can then be driven through the holes into the batten below, thereby securing both tiles to the batten (although it may be considered unnecessary to nail down all pairs of tiles). This procedure can continue for an entire row/course of side-by-side tiles. The next row/course of tiles can then be laid. FIG. 4 shows a tile 100 with a portion of another tile 100' overlapping at its upper edge 104A. Also shown schematically in the semi-transparent/cross-sectional side view of FIG. 4 is a protrusion 114' of a tile laid to the side of the first tile 100. A nail 401 is shown passing through the hole 115 in the tile 100 as well as slot 118 in the adjacent tile. Part of the upper tile 100' overlaps portions (which include the nail holes) at the upper edges of the underlying interlocked tiles. The length of the exposed part of the underlying tiles is called the "gauge". The underside formation (109) of the upper tile 100' fits into ones of the apertures 110A-110C of the lower tile 100. The provision of more than one upper surface formation on the tile means that the overlying tile can fit into one of several corresponding formations, thereby allowing the gauge of the tiling to be adjusted.

The usual gauge for roof tiling will be 300 mm, which in the example tile is selected by inserting the underside projection into the aperture 110A nearest the top edge 102A. The next aperture 110B down can provide a gauge of 285 mm and the third aperture 110C a gauge of 275 mm, for example. Thus, each aperture can allow for stretching of up to around 10 mm, although it will be understood that this could be varied. To illustrate, for a roofing area having a measurement of around 6096 mm (20') from fascia to ridge, 20 courses at the 300 mm gauge mm would be required. However, the plurality of apertures allows variation. For example, if the distance between the fascia and ridge of a roof was reduced to around 5941 mm (19' 6") then the first aperture 110A would be used for the first 14 courses at the 300 mm gauge. Then, to compensate for the loss of around 155 mm (6"), the remaining 6 courses would be laid at the 275 mm gauge. It will be understood that the positioning of the apertures (and/or underside projections) can be varied to give any desired range of gauges. For example, aperture 110A could provide a 280 mm gauge, aperture 110B a 265 mm gauge and aperture 110C a 250 mm gauge.

The underside protrusions of the first course of tiles laid (normally the eaves) can be fixed by providing an arrangement including a set of suitable apertures/bores. These can be provided on strips of material, e.g. recycled plastic, which can be sold in regular lengths, e.g. 1 m. The strips can be fixed, by means of nails or screws, etc, to the top of the fascia board, gable end to gable end.

FIG. 5 shows an alternative example 200 of the tile. Elongate slots 511A-511C (e.g. 10 mm) extend outwards from the sides of the holes 110A'-110C. This allows for sideways movement/stretching of the overlapping tile over a range of around 10 mm, although it will be understood that slots of any reasonable width could be provided.

FIGS. 6A, 6B and 6C show another alternative version 300 of the tile. This tile 300 can includes features common to the examples described above, except that its width is substantially equivalent to one and a half times the width of the other tiles 100 (i.e. around 50% wider, e.g. around 450 mm). This type of tile can be used alternately on gable end verges in order to form a roof pattern commonly known as "broken bond" or "half bond". A "normal" width of the tile may be marked by a line 301 on its upper surface, but it will be understood that this is optional and the main surface of the tile 300 may be formed of one or more component. The number/location of nibs 106 and/or sets of slots 110 and/or underside arrangements 109' on this type of tile may differ from those of the "normal width" tile 100. In the example, there are three sets of upper surface arrangements 110A-110C, 110A"-110C", 110A'-110C' arranged in a line at spaced-apart intervals near the upper edge of the tile, which allows the tiles to be arranged using different types of bonds, e.g. straight bond (where side edges of the tile and the underlying one are aligned) or half/broken bond.

FIG. 6C also shows an alternative version of the underside arrangement 109', which includes a pair of spaced-apart, semi-rigid arms 109A, 109B with transverse protrusions on their ends that can snap into one of the apertures 110A-110C.

FIGS. 7A, 7B and 7C show yet another alternative version 400 of the tile. This tile can include the majority of the features of any of the embodiments described above, except that it does not include a projecting fin/arrangement 114 on its left (or right) hand side. This type of tile is intended to be fitted on the end of a row of tiles (normally at the edge of a roof), where there is no adjacent interlocking tile. Instead of the fin 114, the left hand side can include a slot 401, or any other arrangement, such as a set of projections, for receiving/connecting to a verge attachment (not shown) for decorative purposes. The slot 401 may be similar to slot 112 of tile 100. Alternatively, the left hand side can be solid. It will be understood that a version of the tile 400 suitable for fitting on the opposite end of a row of tiles can also be produced. The tile can either have the same width (e.g. 300 mm) as one of the conventional tiles 100, or the same width (e.g. 450 mm) as one of the "tile and a half" width tiles 300.

Referring to FIGS. 8A and 8B, there is shown a clipping device 802. The clipping device is normally intended to be fitted to a fascia 804 of a building structure, adjacent a lower edge of the roof. The device 802 may be fitted on the fascia by means of adhesive, screws, nails or the like. The device 802 includes an elongate main body 804 that includes a partially circular (in cross section) bore. In the bore there is fitted a pivotable member 806. The member 806 includes a generally circular portion that is pivotably mounted within the bore and at least one tile-receiving portion 808 that protrudes outwardly from the bore. The components of the device 802 may be formed of plastic or any other suitable material.

The tile-receiving portion 808 comprises a slot into which a portion 810 on the underside of the a 812 is fitted. In the example the tile portion 810 comprises an elongate member that may have a rounded/bulbous push-in end that fits into a correspondingly-shaped inner surface of the tile-receiving portion, but it will be understood that variations are possible, e.g. the tile-receiving portion could be configured to receive one or more of the underside portions/projections 109 or 118 described above. However, it will be understood that the clipping device 802 may be adapted for use with tiles other than the examples described above. The connection between the pivotable member and the main may be such that friction keeps it in position after the angle of the tile 812 has been set to correspond generally with the pitch of the roof, although in alternative versions a pin or the like may be used to keep the pivotable member in position.

The device 802 may be of a length sufficient to accommodate one or more tiles. Where it can connect to more than one tile, there may be a separate/independent pivotable member for each tile (e.g. three are shown in the example of FIG. 8B). The tile in the example overhangs a drip tray 814 that leads to guttering 816. There is also a ventilated drip tray 818 on the other side of the fascia.

The invention claimed is:

1. An interlockable tile (100) including:

a plurality of sets of upper surface arrangements (110A-110C, 110A'-110C') and a corresponding plurality of underside arrangements (109'), with a first one of the sets of the upper surface arrangements (110A-110C) and a first one of the underside arrangements being located at or adjacent a first side edge (104C) of the tile (100) and a second one of the sets of the upper surface arrangements (110A'-110C') and a second one of the underside arrangements being located at or adjacent an opposite side edge (104D) of the tile, in use, the upper surface arrangement of the tile interlocking with a corresponding underside arrangement on an overlapping tile;

a first formation (114) at or adjacent a side edge (104C), and a second formation (112) at or adjacent an opposite side edge (104D) that, in use, interlocks with a corresponding said first formation of an adjacent tile, characterized in that each of the underside arrangements (109') and/or each said set of the upper surface arrangements (110A-110C, 110A'-110C') of the tile includes a plurality of formations spaced from an upper or lower edge of the tile by different distances so that, in use, the plurality of formations provide a range of tiling gauges for the overlapping tiles.

2. A tile according to claim 1, wherein the first side formation includes a first preformed aperture (118) for receiving, in use, a fixing device (401) and the second side formation includes a second preformed aperture (115) for receiving, in use, the fixing device such that when, the first side formation is interlocked with a said second side formation of another tile, the first and second apertures are aligned to allow the fixing device to pass through the first and second apertures.

3. A tile according to claim 2, wherein at least one of the first (118) and second (115) apertures is elongate.

4. A tile according to claim 3, wherein the first side formation includes an elongate protrusion (114) and the second side formation includes a recess (112) or slot in the opposite side edge (104D).

5. A tile according to claim 3, wherein engagement of the first (114) and second (112) side formations, in use when the tile (100) is interlocked with an adjacent tile (100'), allows an upper surface of the tile to lie flush with an upper surface of the interlocked tile.

6. A tile according to claim 4, wherein at least a portion of the elongate protrusion (116) is angled to form a water run located, in use, beneath a join between side edges (104C, 104D) of adjacent tiles (100, 100').

7. A tile according to claim 1, wherein the plurality of upper surface arrangements (110A-110C), or underside (109), arrangements include a set of apertures (110A-110C) arranged in a line at or near an upper edge portion (104A) of the tile (100).

8. A tile according to claim 7, wherein all or some of the plurality of upper surface apertures (110A-110C) have an associated an elongate slot (511A -511C) that extends sideways across the tile (100), thereby, in use, allowing for sideways movement of another tile that is interlocked with the tile.

9. A tile according to claim 7, wherein at least one of the underside arrangements is arranged at or near a lower edge portion (104B) of the tile (100) and include a projection (109) dimensioned to fit in one of the set of apertures (110A-110C) of another said tile.

10. A tile according to claim 9, including at least one further set of the upper surface arrangements (110A"-110C") located between the first and second said sets of the upper surface arrangements and at least one further underside arrangement located between the first and second of the underside arrangements.

11. A tile according to claim 1, further including a nib (106) that, in use, hooks over a roofing batten (102A).

12. A tile according to claim 11, further including a preformed aperture for receiving, in use, a fixing device such as a nail.

13. A tile according to claim 11, wherein a portion of the nib (106) is formed on the first side edge formation (114).

14. A tile according to claim 1, wherein an underside of the tile (100) further includes a reinforcing rib (107).

15. A tile according to claim 14, wherein the reinforcing rib comprises an elongate member (107) having a V-shaped cross-section that extends between the first side edge (104C) and the opposite side edge (104D) of the tile (100).

16. A tile according to claim 1, including a profiled section/foot (102) at a lower edge (104B) of the tile (100), in use, the profiled section overlapping an upper portion of an overlapping tile.

17. A tile according to claim 1, wherein the tile (100) is generally square or rectangular in plan view.

18. A tile according to claim 1, wherein the tile (100) is formed of a rigid recycled plastic material.

19. A tile according to claim 1, wherein a side edge portion of the tile (400) includes an arrangement (401) for receiving/connecting to a verge attachment.

20. A tile according to claim 1, wherein the underside arrangement of the tile (812) is, in use, fitted into a clipping device (802) having at least one pivotable member (808) including an arrangement for receiving the tile underside arrangement, the pivotable member being pivotable so as to allow the tile to be fitted at an angle corresponding to a pitch of a roof.

21. A tile according to claim 20, wherein the clipping device (802) is fitted on a fascia (804) of a building structure.

22. A set of tiles (100) according to claim 1.

23. A set of tiles according to claim 22, wherein at least one of the tiles (300) in the set is around 50% wider than other tiles (100) in the set.

24. A kit including a set of tiles (100) according to claim 23 and a set of strips of material adapted to fix the tiles to a fascia board.

25. A roof or building structure laid with a set of tiles according to claim 23.

26. A method of laying a set of roof tiles (100) according to claim 23, the method including laying a first said tile (100) in the set on a roof batten (102) and laying a next tile (100') in the set such that the formations (114, 112; 109, 110) of the tiles interlock.

* * * * *